US006128394A

United States Patent [19]

Hayakawa et al.

[11] Patent Number: 6,128,394

[45] Date of Patent: Oct. 3, 2000

[54] SPEAKER APPARATUS AND WATERPROOF COVER THEREFOR

[75] Inventors: Fujio Hayakawa, Tokyo; Jun Yoshida, Hyogo; Ikuo Saga; Taizo Nakamura, both of Aichi, all of Japan

[73] Assignees: Mitsubishi Jidosha Kogyo Kabushiki Kaisha; Mitsubishi Denki Kabushki Kaisha, both of Tokyo, Japan

[21] Appl. No.: 09/176,774

[22] Filed: Oct. 22, 1998

[30] Foreign Application Priority Data

Mar. 31, 1998 [JP] Japan ..... 10-086919

[51] Int. Cl.[7] ..... H04R 25/00

[52] U.S. Cl. ..... 381/386; 381/189; 381/391; 181/149

[58] Field of Search ..... 381/386, 389, 381/391, 395, 189, 340, 361, FOR 165, 152, FOR 151; 181/149, 150; 340/388.1, 399.1, 391.1

[56] References Cited

U.S. PATENT DOCUMENTS 4,550,229 10/1985 Hwang ..... 381/397

FOREIGN PATENT DOCUMENTS

| | | |
|---|---|---|
| 0 712 758 A1 | 5/1996 | European Pat. Off. . |
| 296 14 826 U | 11/1996 | Germany . |
| 61-6702 | 2/1985 | Japan . |
| 1-261999 | 10/1989 | Japan . |
| 5-344572 | 12/1993 | Japan . |
| 7-117570 | 5/1995 | Japan . |
| 8-079866 | 3/1996 | Japan . |
| 8-132977 | 5/1996 | Japan . |
| 10-042391 | 2/1998 | Japan . |

*Primary Examiner*—Huyen Le
*Attorney, Agent, or Firm*—Sughrue, Mion, Zinn, Macpeak & Seas, PLLC

[57] ABSTRACT

In order to reduce the possibility of moisture, which has seeped into a door from its lower side, contacting with a speaker and also of air pressure building up behind the speaker and hindering the movement of the diaphragm, a waterproof cover 3 is provided which includes a magnet cover 31 which follows the circumference of a magnet 16, a frame cover 32 which partially overlaps with the magnet cover 31 and follows the circumference of the frame 15 when it is combined with a speaker 2, a first aperture 33 placed between the magnet 16 and the magnet cover 31 and a second aperture 34 placed between the magnet cover 31 and the frame cover 32.

15 Claims, 5 Drawing Sheets

SPEAKER APPARATUS AND WATERPROOF COVER THEREFOR

BACKGROUND OF THE INVENTION

1. Field of the Invention

This invention relates to a speaker apparatus and waterproof cover therefor attached to automobile doors and the like.

2. Description of the Prior Art

Example 1

Diagram 7 is a block diagram showing the first example of a conventional speaker apparatus and shows the speaker as attached to an automobile door, in the diagram, reference numeral 101 designates the speaker apparatus, 102 is the speaker, 103 is the waterproof cover, 104 is the inner panel which is the interior panel constituting the door of the automobile, and 105 is moisture which has seeped inside from the upper side of the door.

The speaker apparatus 101 is thus constituted by the speaker 102 and the waterproof cover 103. It is affixed to the inner panel 104 by means of a screw. In the speaker 102, the reference numeral 111 designates the diaphragm, 112 is the dustcap which functions as a dustproof means, 115 is the frame supporting the components constituting the speaker 102, 116 is an annular magnet, and 117 and 121 are plate and a pole piece respectively which guide the magnet force generated by the magnet 116.

In the speaker 102, the base of the diaphragm 111 is connected to the forward end of the bobbin (not shown in the figure) and the outer peripheral edge of the diaphragm 111 is connected to the inner peripheral edge of the edge member (not shown in the figure). Further, the dustcap 112 is connected to the front central surface of the diaphragm 111. The magnet 116 is closely attached to the plate 117 and the pole piece 121 with the plate 117 in turn being attached to the frame 115.

The waterproof cover 103 is provided at the back of the speaker 102 only covering the upper side.

The type of conventional speaker apparatus 101 as shown in example 1 prevents moisture 105 which has seeped into the door from its upper side from contacting with the speaker 102 by means of a waterproof cover 103. Furthermore the provision of a waterproof cover 103 at the back of the speaker 102 covering only its top portion prevents interference to movement of the diaphragm 111 due to increased air pressure at the back of the speaker 102.

Example 2

Diagram 8 is a block diagram showing the second example of a conventional speaker as disclosed for example in laid open utility model 61-6702. In FIG. 8, the speaker is shown as attached to a door of an automobile. In the diagram, reference numeral 131 is the speaker apparatus, and 133 is the waterproof cover. All other components are equal or equivalent to those having like reference numerals in FIG. 7.

Thus the speaker apparatus 131 comprises the speaker 102 and the water proofcover 133 and is affixed to the inner panel 104 by a screw.

The water proof cover 133 is provided so as to cover the entire back of the speaker 102. A plurality of apertures 133*a* are provided in the waterproof cover 133 communicating from its inner to its outer side. These apertures 133*a* are formed by projecting downwardly the upper edge of the hub formed by the waterproof cover 133.

In the conventional speaker apparatus 131 as shown in example 2, moisture 105 seeping into the door from its upper side or lower section is prevented from contacting with the speaker 102 by the waterproof cover 133. Furthermore the provision of apertures 133*a* in the waterproof cover prevents interference to movement of the diaphragm due to heightened air pressure behind the speaker 102.

As is clear from the above, the conventional speaker, shown in example 1, provides a water proofcover only at the upper side of the back of the speaker and as a result the problem arises that moisture may contact with the speaker by seepage from the lower part of the door.

Furthermore as shown above, the speaker shown in example 2 provides for apertures formed by projecting downwardly the upper edge of the hub. However since the area of the apertures communicating with the inner and outer sides of the waterproof cover is small, the problem arises that movement of the diaphragm may be hindered due to increased air pressure behind the speaker.

SUMMARY OF THE INVENTION

In order to solve the above problems, it is the object of the present invention to provide a speaker apparatus and waterproof cover which reduce the possibility of both moisture contacting with the speaker and an increase in air pressure behind the speaker.

In a first aspect of the invention, a speaker apparatus is provided with a waterproof cover which includes a magnet cover which follows the circumference of the magnet, a frame cover following the circumference of the frame and partially overlaying the magnet cover, a first aperture placed between the magnet cover and magnet and a second aperture placed between the magnet cover and the frame cover.

With the above arrangement, a speaker apparatus is provided that reduces the possibility both of moisture contacting with the speaker and of an increase in air pressure behind the speaker.

In the present invention, the speaker apparatus may also provide a magnet cover including a first protector on the side of the frame cover.

A speaker apparatus with the above structure reduces the possibility of moisture seeping into the waterproof cover from the second aperture.

In the present invention, the speaker apparatus may also provide for a first protector which includes both upper and lower protectors, the width of the first upper protector being greater than that of the first lower cover.

In such a manner, a speaker apparatus with the above structure reduces the possibility of moisture which has accumulated on the upper outer surface of the magnet cover from seeping into the waterproof cover from the second upper aperture.

In the present invention, the speaker apparatus may also provide a frame cover with a second protector on the side facing the magnet cover.

With such an arrangement, the possibility of moisture seeping into the waterproof cover from the second aperture is reduced.

In the invention, the speaker apparatus may provide a second protector which includes both upper and lower protectors, the width of the second lower protector being greater than that of the second upper protector.

With this arrangement, the speaker apparatus minimizes the possibility of moisture which has accumulated on the lower inner surface of the frame cover from seeping into the waterproof cover from the second lower aperture.

The speaker apparatus of the present invention also provides for a frame cover having water outlets on the lower part of the side opposite the magnet cover.

A speaker apparatus with the above arrangement can discharge, via the water outlet, moisture which has entered the waterproof cover.

The speaker apparatus of the present invention also provides a waterproof cover which includes a connecting member which extends downwardly from the magnet cover towards the frame cover and connects the frame cover with the magnet cover.

A speaker apparatus with this arrangement can allow moisture which has accumulated on the connecting member to flow out onto the outer side of the waterproof cover.

In a second aspect of the present invention, the waterproof cover of the speaker apparatus includes a magnet cover which follows the circumference of the magnet when it is connected to the speaker, a frame cover which both partially overlaps with the magnet cover and follows the circumference of the frame when it is connected to the speaker, a first aperture placed between the magnet and the magnet cover when connected to the speaker, and a second aperture which is placed between the magnet cover and the frame cover.

When the above arrangement is connected to a speaker to form a speaker apparatus, the possibility of both moisture contacting with the speaker and of increased air pressure behind the speaker is reduced.

According to the present invention, the waterproof cover of the speaker apparatus may provide a magnet cover which has a first protector on the side facing the frame cover.

When this arrangement is connected to a speaker to form a speaker apparatus, the possibility of water entering the waterproof cover from the second aperture is reduced.

The present invention may also provide a waterproof cover for a speaker apparatus in which the first protector includes both an upper and a lower protector, the width of the first upper protector being greater than that of the first lower protector.

When this arrangement is connected to a speaker to form a speaker apparatus, the possibility of moisture, which has accumulated on the upper outer surface of the side of the magnet cover, seeping into the waterproof cover from the second upper aperture is reduced.

The present invention also provides for a waterproof cover of a speaker apparatus in which the frame cover includes a second protector on the side of the magnet cover.

When this arrangement is combined with a speaker to form a speaker apparatus, the possibility of moisture entering the waterproof cover from the second aperture is reduced.

In the present invention, the waterproof cover of the speaker apparatus can provide a second protector which includes both an upper and a lower protector, the width of the second lower protector being greater than that of the second upper protector.

When the above arrangement is combined with a speaker to form a speaker apparatus, the possibility of moisture which has accumulated on the lower inner surface of the frame cover entering the waterproof cover from the second lower aperture is reduced.

In the present invention, the waterproof cover of the speaker apparatus can provide a frame cover which includes a water outlets on the lower side opposite the magnet cover.

When the arrangement above is combined with a speaker to form a speaker apparatus, it is possible for moisture which has entered the waterproof cover to be discharged from the water outlets.

The present invention also provides a waterproof cover for a speaker apparatus which includes a connecting member which extends downwardly from the magnet cover towards the frame cover and connects the magnet cover and the frame cover.

When the above arrangement is connected with a speaker to form a speaker apparatus, moisture which has accumulated on the connecting member can flow out on the outer side of the waterproof cover.

DETAILED DESCRIPTION OF THE PREFERRED EMBODIMENTS

The embodiments of the invention are discussed below.

Embodiment 1.

Figure 1:
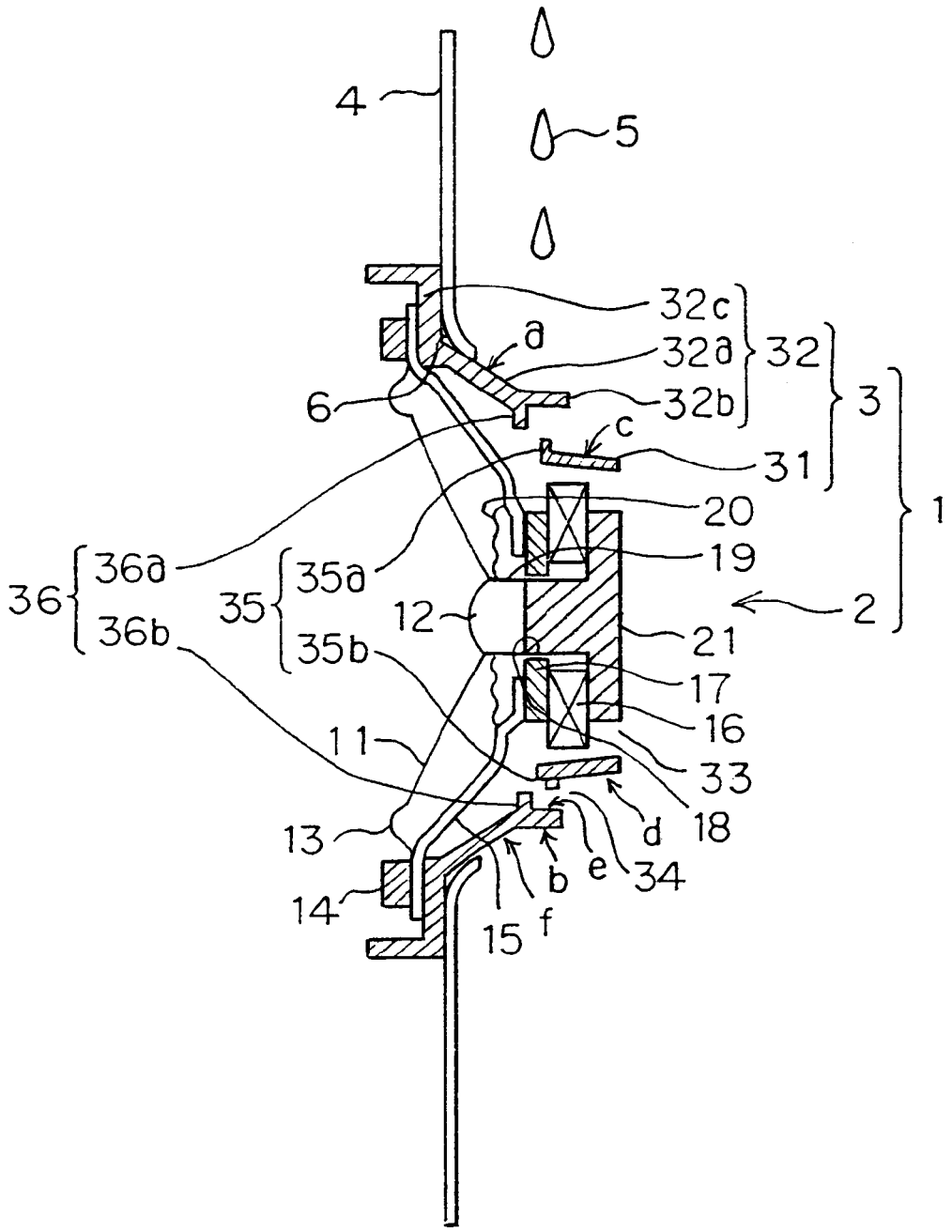
FIG. 1 is a cross-sectional view showing the speaker apparatus according to the first embodiment of the present invention.
Figure 2:
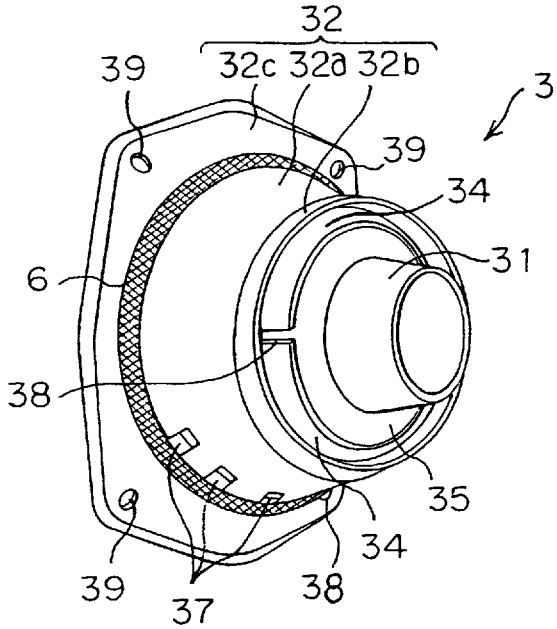
FIG. 2 is a perspective view showing the waterproof cover of the speaker apparatus according to the first embodiment of the present invention.

FIG. 1 is a cross-sectional view showing the speaker apparatus according to the first embodiment of the invention. FIG. 2 is a perspective view showing the waterproof cover of the speaker apparatus according to embodiment 1 of the invention. FIG. 1 shows the speaker apparatus as attached to the door of an automobile. In the figure, reference numeral 1 represents the speaker apparatus, 2 is the speaker, 3 is the waterproof cover, 4 is the inner panel which is the panel in the interior of the automobile comprising the door of the automobile, 5 is moisture which has seeped into the door from its upper side, 6 is a foam cushion such as "Epurashito" ( the trade name of the Chiyoda Integuru Company) which prevents moisture from entering between the waterproof cover 3 and the inner panel 4 when the speaker apparatus 1 is attached to the inner panel 4.

The speaker apparatus 1 is thus comprised of the speaker 2 and the waterproof cover 3 and is attached to the inner panel 4 by means of a screw.

In the speaker 2, reference numeral 11 represents a diaphragm, 12 is a dustcap which functions as a dust-proof means, 13 is an edge member supporting the diaphragm, 14 is the gasket which holds the edge member in place, 15 is a frame which supports the elements constituting the speaker 2, 16 is an annular magnet, 17 is a plate which guides the magnet force generated by the magnet 16, 18 is a voice coil, 19 is a bobbin around which the voice coil 18 is coiled, 20 is a damper supporting the bobbin 19, 21 is a pole piece guiding the magnet force generated by the magnet 16.

In this way, the speaker 2 includes the frame 15 and the magnet 16.

In the speaker 2, the base of the diaphragm 11 is connected to the forward end of the bobbin 19 and the outer peripheral edge of the diaphragm 11 is connected to the inner peripheral edge of the edge member 13. Furthermore, the dustcap 12 is connected to the front central surface of the diaphragm 11. The magnet 16 adheres closely to the plate 17 and the pole piece 21 with the plate 17 being attached to the frame 15. The bobbin 19 is supported by the damper 20 and is arranged in the space between the pole piece 21 and the plate 17. Furthermore, the damper 20 is attached to the frame 15.

In the waterproof cover 3, 31 is the magnet cover which follows the circumference of the magnet 16 when it is attached to the speaker 2, 32 is the frame cover which both partially overlaps with the magnet cover 31 by slightly entering inside it and follows the circumference of the frame 15 when it is attached to the speaker 2, 33 is a first aperture placed between the magnet cover 31 and the magnet 16 when attached to the speaker 2, 34 is a second aperture placed between the magnet cover 31 and the frame cover 32, 35 is a first protector provided on the frame cover side 32 of the magnet cover 31, 36 is a second protector provided on the magnet cover 31 side of the frame cover 32, 37 are the water outlets provided on the lower side of the frame cover 32 on the side opposite to the magnet cover 31, 38 is the connecting member connecting the magnet cover 31 and the frame cover 32 and 39 is screw hole for connecting the waterproof cover 3 to the inner panel 4 by a screw.

In such a way, the waterproof cover 3 is comprised of magnet cover 31, frame cover 32, the first aperture 33, the second aperture 34, the first protector 35, the second protector 36, the water outlets 37 and the connecting member 38.

The magnet cover 31 is formed by a short cylindrical section, the inner diameter of which increases slightly as it approaches the frame cover 32. When the waterproof cover 3 is connected to the speaker 2, the lateral end of the magnet cover 31 near the frame cover 32 is placed on the circumference of the plate 17 and its other end placed on the circumference of the end surface of the pole piece 21.

The frame cover 32 is formed by the conical cylindrical section 32*a* which inclines with slowly decreasing inner radius towards the side of the magnet cover 31, the cylindrical section 32*b*, which is placed on the lateral end of the conical cylindrical section 32*a* near the magnet cover 31, has the same inner radius as that defined by the conical cylindrical section 32*a* and extends toward the side of the magnet cover 31, and the backing section 32*c* placed on the end which is opposite to the lateral end of the conical cylindrical section 32*a* near the magnet cover 31 and which adheres closely to the inner panel 4 when it is attached thereto. When the waterproof cover 3 is attached to the speaker 2, the lateral end of the conical cylindrical section 32*a* of the frame cover 32 near the magnet cover 31 is placed around the contact surface of the frame 15 and the plate 17. The lateral end of the cylindrical section 32*b* of the frame cover 32 near the magnet cover 31 is placed along the magnet 16. The cylindrical section 32*b* of the frame cover 32 partially overlays the magnet cover 31, the length of overlay being 5–20 mm. In the frame cover 32, a cushion 6 of 5–10 mm width is adhered to the border of the conical cylindrical section 32*a* and the backing section 32*c*.

The inner diameter of the magnet cover 31 is greater than the outer diameter of the magnet 16 of the speaker 2 used when combined to the waterproof cover 3. Furthermore the outer diameter of the first protector 35 provided on the magnet cover 31 near the frame cover 32 is smaller than the inner diameter of the frame cover 32. The inner diameter of the second protector 36 provided on the side of the frame cover 32 near the magnet cover 31 is smaller than the outer diameter of the magnet cover 31. The interval between the frame cover 32 and the first protector 35, and the magnet cover 31 and the second protector 36 is 5–20 mm. The inner diameter of the frame cover 32 is greater than the outer diameter of the frame 15 of the speaker 2 used when joined to the waterproof cover 3.

The first protector 35 is placed near or on the lateral end of the frame cover 32 on the inner surface of the magnet cover 31. The first protector 35 includes the first upper protector 35*a* placed on the top of the magnet cover 31 and the first lower protector 35*b* placed on the bottom of the magnet cover 31. The width of the first upper protector 35*a* is greater than the width of the first lower protector 35*b*.

The second protector 36 is placed on the border of the conical cylindrical section 32*a* and the conical section 32*b* on the inner surface of the frame cover 32. The second protector 36 includes the second upper protector 36*a* placed on the top of the frame cover 32 and second lower protector 36*b* placed on the bottom of the frame cover 32. The width of the second lower protector 36*b* is greater than that of the second upper protector 36*a*.

The operation of the invention will now be explained.

If moisture which has seeped into the door from its upper side falls onto the upper outer surface of the conical cylindrical section 32*a* of the frame cover 32 (shown in diagram 1 as "a"), the moisture will flow down the sloping surface of the conical cylindrical section 32*a*. If the moisture reaches the cylindrical section 32*b* of the frame cover 32, the moisture will be lead to the outer peripheral surface of the cylindrical section 32*b* and fall onto the lower side of the cylindrical section 32*b* and reach the lower outer surface of the cylindrical section 32*b* of the frame cover 32 (shown in diagram 1 as "b").

Since moisture falling onto the upper outer surface of the conical cylindrical section 32*a* of the frame cover 32 moves in the fashion described above, there is little possibility of its entering the waterproof cover 3 from the first or second apertures 33,34.

Furthermore moisture entering the door from its upper side and falling onto the upper outer surface of the magnet cover 31 (shown in diagram 1 as "c") will be led to the outer peripheral surface of the magnet cover 31, fall onto its lower side and reach its lower outer surface (shown in diagram 1 at "d").

Since moisture falling onto the upper outer surface of the magnet cover 31 moves in the fashion described above, there is little possibility of its entering the waterproof cover 3 from the first or second apertures 33, 34.

Even if some moisture falls onto the upper outer surface of the magnet cover 31 and splashes on the surface, due to the provision of a first upper protector 35*a* on the top of the magnet cover 31 in its upper surface, the provision of a second upper protector 36*a* on the top of the frame cover 32 in its inner surface and the fact that the distance between the frame cover 32 and the first protector 35, and the magnet cover 31 and the second protector 36 is 5–20 mm, there is little possibility of splashing moisture entering the waterproof cover 3 from the upper second aperture 34.

Even if a portion of moisture which has reached the lower outer surface of the magnet cover 31 and fallen onto the lower inner surface of the cylindrical section 32*b* of the frame cover 32 splashes, due to the provision of a first lower protector 35*b* on the lower part of the magnet cover 31 in its upper surface, the provision of a second lower protector 36*b* in the lower part of the frame cover 32 in its inner surface and the fact that the distance between first protector 35 and the frame cover 32, and the second protector 36 and the magnet cover 31 is 5 mm–20 mm, there is little possibility of splashing moisture entering the waterproof cover 3 from the lower second aperture 34.

Since the width of the first upper protector 35*a* provided on the upper surface of the magnet cover 31 is greater than that of the first lower protector 35*b* and the width of the lower second protector 36*b* provided on the inner surface of the frame cover 32 is greater than that of the second upper protector 36*a,* there is little possibility of moisture collecting on the upper outer surface of the magnet cover 31 and entering the waterproof cover 3 from the second upper aperture 34, or of moisture collecting lower inner surface of the cylindrical section 32*b* of the frame cover 32 and entering the waterproof cover 3 from the second lower aperture 34.

Furthermore, moisture, which has entered the door from its lower side and contacted with the lower outer surface of the conical cylindrical section 32*a* of the frame cover 32 (shown in diagram 1 as "f"), will fall from the sloping surface of the conical cylindrical section 32*a*.

Since moisture contacting the lower outer surface of the conical cylindrical section 32*a* of the frame cover 32 will move in the fashion above, there is little possibility of its entering the waterproof cover 3 from the first or second apertures 33, 34.

Furthermore, even if a portion of moisture that has entered the door from its lower part, contacted the lower inner surface of the cylindrical section 32*b* of the frame cover 32 or the lower outer surface of the magnet cover 31 and has splashed, due to the provision of a first lower protector 35*b* on the lower part of the magnet cover 31 in its upper surface, the provision of a second lower protector 36*b* on the lower part of the frame cover 32 in its inner surface and the fact that the distance between the first protector 35 and the frame cover 32, and the second protector 36 and the magnet cover 31 is 5–20 mm, there is little possibility of such splashing moisture entering the waterproof cover 3 from the second lower aperture 34.

In the manner above, according to the first embodiment, since the waterproof cover 3 includes a magnet cover 31 which follows the circumference of the magnet 16 when it is combined with the speaker 2 and a frame cover 32 which partially overlaps with the magnet cover 31 and follows the circumference of the frame 15 when it is combined with the speaker 2, not only moisture entering from the top side of the door but also moisture entering from the lower part of the door is unlikely to contact the speaker.

Furthermore, in accordance with embodiment 1, since the waterproof cover 3 includes a first aperture 33 placed between the magnet cover 31 and the magnet 16 when combined with the speaker 2 and a second aperture 34 placed between the frame cover 32 and the magnet cover 31, the area of apertures communicating between the inner and outer sides of the waterproof cover 3 is large and thus reduces the possibility of an increase in air pressure behind the speaker 2.

Furthermore according to the first embodiment, due to the provision of a first protector 35 on the frame cover 32 side of the upper surface of the magnet cover 31 and the provision of second protector 36 on the magnet cover side 31 of the inner surface of the frame cover 32, moisture splashing on the upper outer surface of the magnet cover 31 is unlikely to enter the waterproof cover 3 from the second upper aperture 34. Also moisture splashing on the lower inner surface of the frame cover 32 is unlikely to enter the waterproof cover 3 from the lower second aperture 34.

Furthermore, according to the first embodiment, since the width of the first upper protector 35a provided on the upper surface of the magnet cover 31 is greater than that of the first lower protector 35*b,* and the width of the second lower protector 36*b* provided on the inner surface of the frame cover 32 is greater than that of the second upper protector 36*a,* moisture building up on the upper outside surface of the magnet cover 31 is unlikely to enter the waterproof cover 3 from the upper second aperture 34. Moisture that has built up on the lower inner surface of the cylindrical section 32*b* of the frame cover 32 is also unlikely to enter the waterproof cover 3 from the second lower aperture 34.

Furthermore, according to embodiment 1, water outlets 37 are provided on the lower side of the frame cover 32 opposite to the magnet cover 31 and allow moisture that has entered the waterproof cover 3 to be discharged from the water outlets 37.

Embodiment 2.

Figure 3:
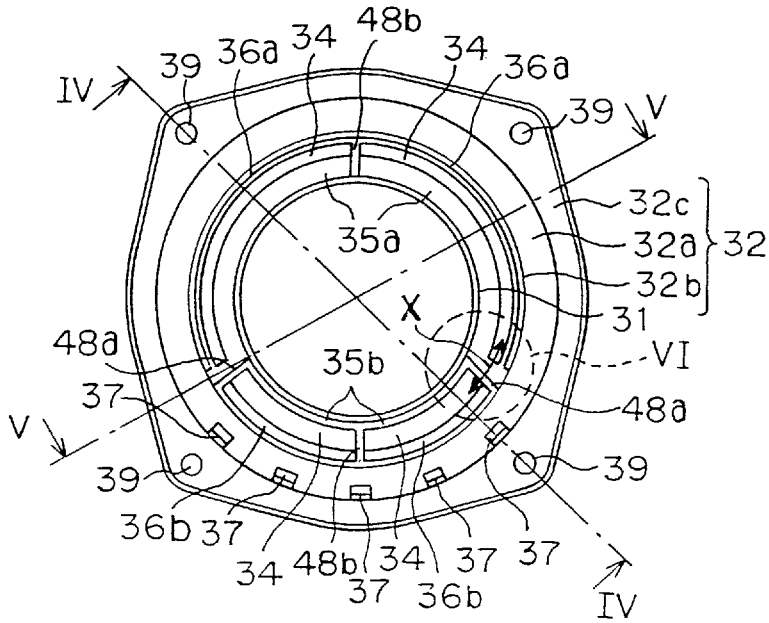
FIG. 3 is a frontal view showing the waterproof cover of the speaker apparatus according to the second embodiment of the present invention.
Figure 4:
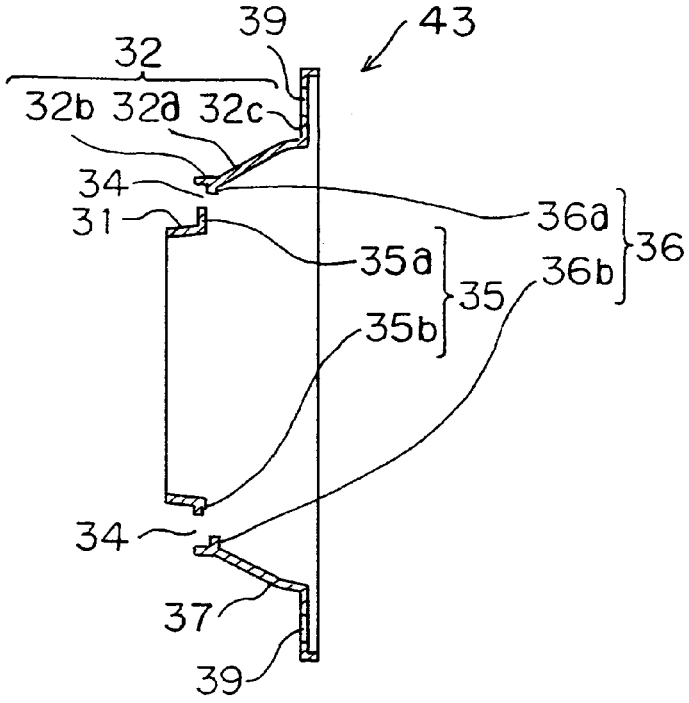
FIG. 4 is a cross-sectional view along the line IV—IV through FIG. 3.
Figure 5:
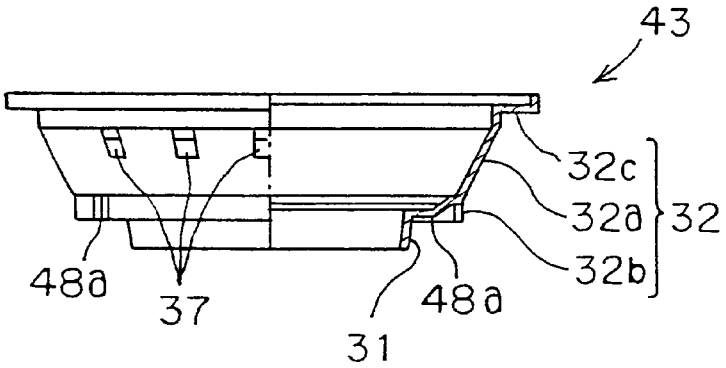
FIG. 5 is a partial cross-sectional view showing a cross-section through line V—V in the right half of Diagram 3 and a side view seen vertically on line V—V in the left half of Diagram 3.
Figure 6:
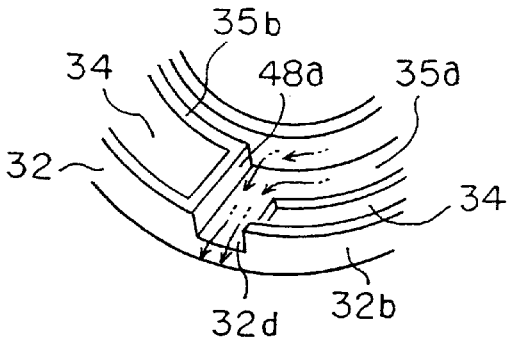
FIG. 6 is a perspective view showing an enlargement of part VI which is inscribed by a broken line in FIG. 3.
Figure 7:
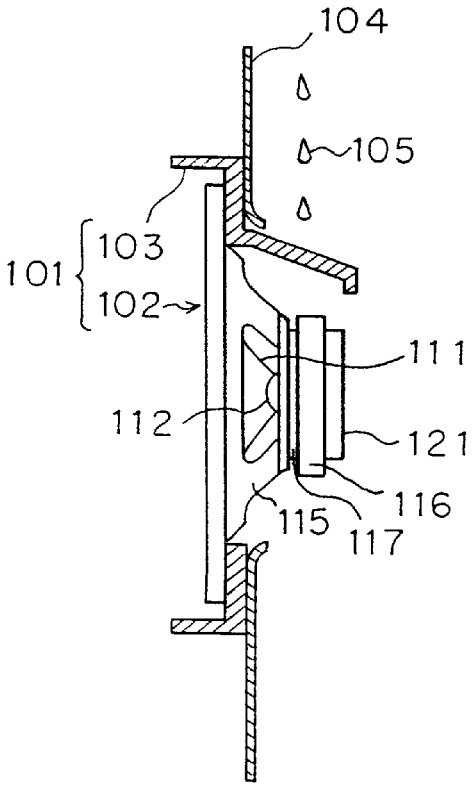
FIG.7 (PRIOR ART)
FIG. 7 is a block diagram showing example 1 of a conventional speaker device.
Figure 8:
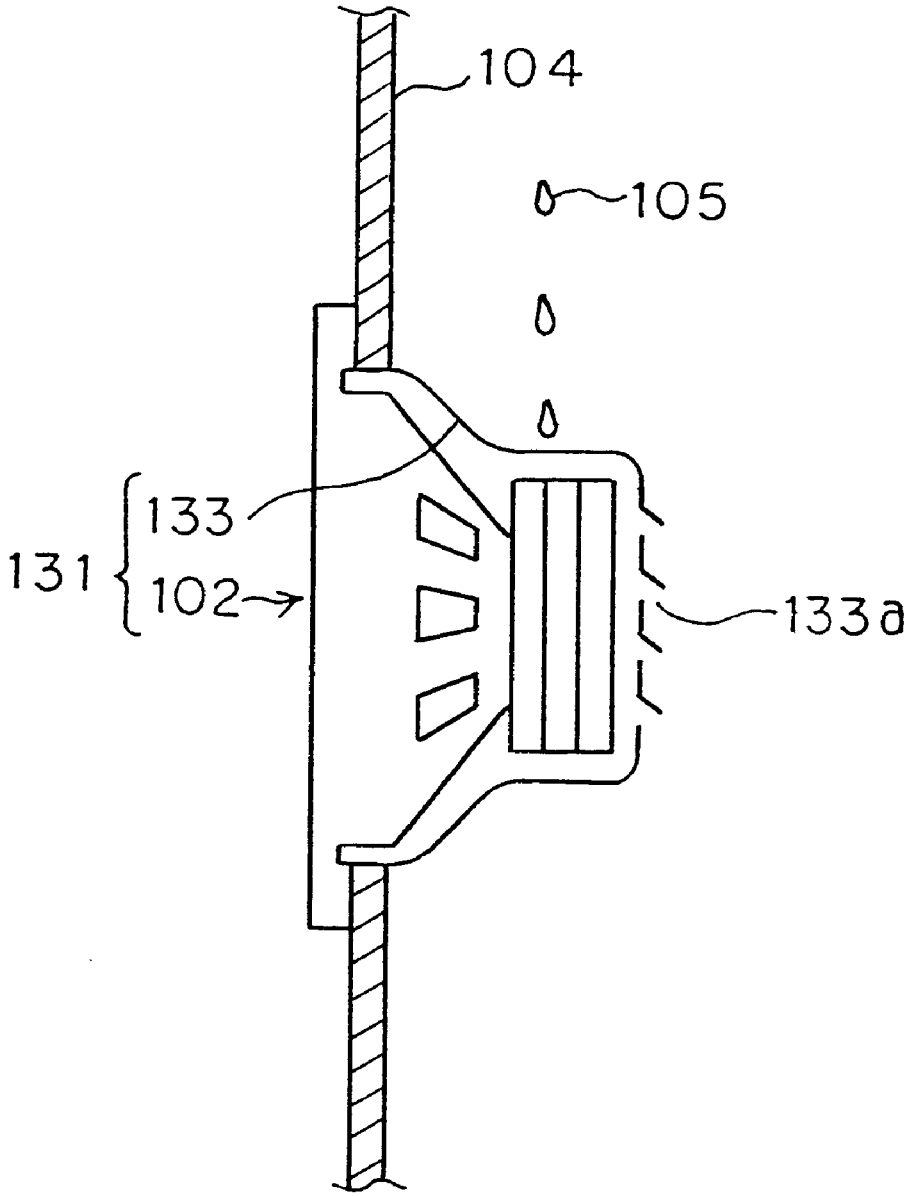
FIG.8 (PRIOR ART)
FIG. 8 is a block diagram showing example 2 of a conventional speaker device.

FIG. 3 is a frontal view showing the waterproof cover of the speaker apparatus according to the second embodiment of the invention. FIG. 4 is a cross-sectional figure along line IV—IV in FIG. 3. FIG. 5 is a partial cross-sectional figure showing a cross-section along the line V—V in the right half of FIG. 3 and a side view seen vertically along line V—V in the left half of FIG. 3. FIG. 6 is a perspective view showing an enlargement of part VI inscribed with a broken line in FIG. 3. In the figures, 43 is a waterproof cover and 48 is a connecting member which connects the magnet cover 31 and the frame cover 32.

In the connecting member, 48*a* is a first connecting member (connecting member) which slopes downwardly from the magnet cover 31 towards the frame cover 32, 48*b* is a second connecting member which extends vertically from the magnet cover 31 towards the frame cover 32.

All other components are equal or equivalent to those having like reference numerals in FIGS. 1 and 2.

The first connecting member 48*a* has a cross-sectional L-shape in the direction of the circumference (direction x in diagram 3).

The cylindrical section 32*b* of the frame cover 32 is provided with a drain to allow moisture that has been stopped by the first connecting member 48 to flow out of the outer surface of the waterproof cover 3.

The operation of the invention will now be explained.

If moisture which has entered the door from its upper part falls onto the upper outer surface of the magnet cover 31, the majority of the moisture will be lead to the outer peripheral surface of the magnet cover 31, fall onto the lower side of the magnet cover 31 and reach the lower outer surface of the magnet cover 31. On the other hand, some moisture will be stopped by the first connecting member 48*a,* flow down the sloping surface of the first connecting member 48*a* which extends downwardly from the magnet cover 31 towards the frame cover 32 and flow out on the outer surface of the waterproof cover 3 from the drain 32*d* provided in the cylindrical section 32*b* of the frame cover 32.

Since moisture falling onto the upper outer surface of the magnet cover 31 moves in the manner described above, it is unlikely to enter the waterproof cover 3 from the first or second apertures 33, 34.

As shown above, the second embodiment can produce the same advantages as the first embodiment.

Furthermore, according to the second embodiment, since there is provided a first connecting member 48*a* extending downwardly from the magnet cover 31 towards the frame cover 32, it is possible for moisture which has been stopped by the connecting member 48*a* to flow off on the outer side of the waterproof cover 3.

What is claimed is:

1. A speaker apparatus comprising:

a speaker having a frame and a magnet;

a waterproof cover comprising a magnet cover following the circumference of said magnet, a frame cover partially overlapping with said magnet cover and following the circumference of said frame, a first aperture placed between said magnet and said magnet cover and a second aperture placed between said magnet cover and said frame cover, wherein at least one of said first aperture and said second aperture provides a passageway from said frame to an exterior portion of said speaker.

2. The speaker apparatus of claim 1, wherein said waterproof cover further comprises:

a first protector located on an outer surface of said magnet cover near a lateral end of said frame cover, said first protector having an outer diameter which is less than an inner diameter of said frame cover.

3. The speaker apparatus of claim 2, wherein said waterproof cover further comprises:

a second protector located on an inner surface of said frame cover, said second protector having an inner diameter which is less than an outer diameter of said magnet cover.

4. The speaker apparatus of claim 1, wherein said waterproof cover further comprises:

a plurality of water outlets located on a lower side of said frame cover which allow moisture that has entered said waterproof cover to be discharged.

5. The speaker apparatus of claim 1, wherein said waterproof cover further comprises:

a connecting member which connects said magnet cover to said frame cover.

6. The speaker apparatus of claim 1, wherein said waterproof cover further comprises:

a first protector located on an outer surface of said magnet cover near a lateral end of said frame cover, said first protector having an outer diameter which is less than an inner diameter of said frame cover;

a second protector located on an inner surface of said frame cover, said second protector having an inner diameter which is less than an outer diameter of said magnet cover;

a plurality of water outlets located on a lower side of said frame cover which allow moisture that has entered said waterproof cover to be discharged; and a connecting member which connects said magnet cover to said frame cover.

7. The speaker apparatus of claim 6, wherein said connecting member slopes downwardly from said magnet cover to said frame cover to allow moisture that has gathered on an outer surface of an upper side of said magnet cover or on an inner surface of an upper side of said frame cover to be discharged.

8. The speaker apparatus of claim 1, wherein said frame cover comprises:

a conical cylindrical section having an inner radius that decreases towards said magnet cover;

a cylindrical section located at a lateral end of said conical cylindrical section near said magnet cover, said cylindrical section having a constant inner radius as said inner radius of said conical cylindrical section at said lateral end and extends outwardly toward a rear portion of said speaker; and a backing section located at an end of said conical cylindrical section opposite to said lateral end and which is used to attach said frame cover to a structure.

9. A waterproof cover for a speaker apparatus comprising:

a magnet cover following the circumference of a magnet when said magnet cover is combined with a speaker;

a frame cover which partially overlaps with said magnet cover and follows the circumference of a frame of said speaker when said frame cover is combined with said speaker;

a first aperture placed between said magnet cover and said magnet when said magnet cover is combined with said speaker; and a second aperture placed between said magnet cover and said frame cover, wherein at least one of said first aperture and said second aperture provides a passageway from said frame to an exterior portion of said speaker.

10. The waterproof cover of claim 9, further comprising:

a first protector located on an outer surface of said magnet cover near a lateral end of said frame cover, said first protector having an outer diameter which is less than an inner diameter of said frame cover.

11. The waterproof cover of claim 10, further comprising:

a second protector located on an inner surface of said frame cover, said second protector having an inner diameter which is less than an outer diameter of said magnet cover.

12. The waterproof cover of claim 9, further comprising:

a plurality of water outlets located on a lower side of said frame cover which allow moisture that has entered said waterproof cover to be discharged.

13. The waterproof cover of claim 9, further comprising:

a connecting member which connects said magnet cover to said frame cover.

14. The waterproof cover of claim 9, further comprising:

a first protector located on an outer surface of said magnet cover near a lateral end of said frame cover, said first protector having an outer diameter which is less than an inner diameter of said frame cover;

a second protector located on an inner surface of said frame cover, said second protector having an inner diameter which is less than an outer diameter of said magnet cover;

a plurality of water outlets located on a lower side of said frame cover which allow moisture that has entered said waterproof cover to be discharged;

a connecting member which connects said magnet cover to said frame cover.

15. The waterproof cover of claim 14, wherein said connecting member slopes downwardly from said magnet cover to said frame cover to allow moisture that has gathered on an outer surface of an upper side of said magnet cover or on an inner surface of an upper side of said frame cover to be discharged.

* * * * *